US012716411B2

(12) United States Patent
Donovan et al.

(10) Patent No.: US 12,716,411 B2
(45) Date of Patent: Aug. 25, 2026

(54) SYSTEMS AND METHODS FOR SIMULATING WATER INTRUSION IN A STRUCTURE AND TESTING SUMP PUMP PERFORMANCE

(71) Applicant: STATE FARM MUTUAL AUTOMOBILE INSURANCE COMPANY, Bloomington, IL (US)

(72) Inventors: John R. Donovan, Bloomington, IL (US); Richard Jan Tjaden, Bloomington, IL (US)

(73) Assignee: STATE FARM MUTUAL AUTOMOBILE INSURANCE COMPANY, Bloomington, IL (US)

( * ) Notice: Subject to any disclaimer, the term of this patent is extended or adjusted under 35 U.S.C. 154(b) by 327 days.

(21) Appl. No.: 18/541,900

(22) Filed: Dec. 15, 2023

(65) Prior Publication Data

US 2024/0410359 A1 Dec. 12, 2024

Related U.S. Application Data

(60) Provisional application No. 63/471,837, filed on Jun. 8, 2023.

(51) Int. Cl.
*F04B 51/00* (2006.01)
*F04B 23/02* (2006.01)

(52) U.S. Cl.
CPC ..... *F04B 51/00* (2013.01); *F04B 23/021* (2013.01)

(58) Field of Classification Search
CPC ..... F04B 51/00
See application file for complete search history.

(56) References Cited

U.S. PATENT DOCUMENTS

| | | | | |
|---|---|---|---|---|
| 6,157,307 | A * | 12/2000 | Hardin | G08B 21/20 73/40 |
| 9,080,924 | B2 * | 7/2015 | Welker | G01M 3/2876 |
| 10,626,873 | B2 * | 4/2020 | Hussain | F04D 15/0236 |
| 11,796,373 | B2 * | 10/2023 | Heady | G01F 23/0007 |
| 2008/0252447 | A1 * | 10/2008 | Atherton | G08B 19/00 340/540 |
| 2015/0227864 | A1 * | 8/2015 | Payne | G06Q 10/067 705/348 |
| 2020/0256042 | A1 * | 8/2020 | Bailey | G01M 3/28 |
| 2020/0340220 | A1 * | 10/2020 | Bailey | G01M 3/3272 |
| 2023/0020473 | A1 * | 1/2023 | Polly | F04B 51/00 |
| 2023/0039308 | A1 * | 2/2023 | Taferner | G01M 3/18 |
| 2024/0426704 | A1 * | 12/2024 | Donovan | G05D 7/0688 |

* cited by examiner

*Primary Examiner* — Eric S. McCall
(74) *Attorney, Agent, or Firm* — MARSHALL, GERSTEIN & BORUN LLP

(57) ABSTRACT

The present aspects relate to techniques for testing water mitigation equipment (e.g., sump pumps and sensors) using a testing platform that simulates a water intrusion environment. The methods and systems of simulating a water intrusion environment discussed herein improve testing and verification of water mitigation devices without the requirement of installing the devices in a real-world structure. A device may include (i) a liquid reservoir comprising a supply cavity configured to hold a volume of a liquid; (ii) a holding sump including a holding cavity; (iii) a first supply line coupled between the liquid reservoir and the holding sump; (iv) a testing sump including the testing cavity; (v) a second supply line coupled between the holding sump and the testing sump; and (vi) a return line coupled between the testing sump and the liquid reservoir.

20 Claims, 8 Drawing Sheets

SYSTEMS AND METHODS FOR SIMULATING WATER INTRUSION IN A STRUCTURE AND TESTING SUMP PUMP PERFORMANCE

CROSS REFERENCE TO RELATED APPLICATIONS

The present application claims the benefit of U.S. Provision Patent Application No. 63/471,837, which was filed on Jun. 8, 2023, and is hereby expressly incorporated by reference herein in its entirety.

FIELD OF THE DISCLOSURE

Systems and methods are disclosed for sump pump and flood monitoring, and more particularly, testing sump pumps and sensors.

BACKGROUND

A sump pump may operate to prevent basements and other underground portions of a structure from flooding. Conventional sensors may detect that a sump pump is faulty and communicate an alert to a user associated with the structure. The user may then contact one or more service providers to have the sump pump repaired or replaced.

To ensure that the sump pump and sensors operate correctly, both may undergo testing in conditions that mirror the operating environment of the structure. The testing may include testing the sump pumps and sensors prior to verification and certification by one or more entities, for example, by insurance companies. Simulating the operating environment of the sump pumps and sensors may not be an easy task. Installing and testing the sump pumps and sensors in a house or building may be time consuming and expensive.

The systems and methods disclosed herein provide solutions to these problems and may provide solutions to the ineffectiveness, insecurities, difficulties, inefficiencies, encumbrances, and/or other drawbacks of conventional techniques.

SUMMARY

The present aspects may relate, inter alia, to techniques for testing water mitigation equipment (e.g., sump pumps and sensors) using a mobile testing platform that simulates a water intrusion environment. The novel methods and systems for simulating a water intrusion environment discussed herein improve testing and verification of water mitigation devices without the requirement of installing the devices in a real-world structure.

In one aspect, a device for simulating water intrusion into a structure may be provided. In one instance, the device may include (i) a liquid reservoir comprising a supply cavity configured to hold a volume of a liquid; (ii) a holding sump including a holding cavity; (iii) a first supply line coupled between the liquid reservoir and the holding sump, wherein the supply line allows the liquid to flow to the holding cavity of the holding sump; (iv) a testing sump including the testing cavity, wherein the testing cavity is configured to receive one or more devices for testing; (v) a second supply line coupled between the holding sump and the testing sump, wherein the second supply line allows the liquid to flow from the holding cavity of the holding sump to the testing cavity of the testing sump; and/or (vi) a return line coupled between the testing sump and the liquid reservoir, wherein the return line allows the liquid to flow from the testing cavity of the testing sump to the supply cavity of the liquid reservoir. The device may include additional, less, or alternate features and components, including those discussed elsewhere herein.

In one aspect, a system for simulating a structure and testing water mitigation equipment may be provided. In one instance, the system may include (i) a liquid reservoir comprising a supply cavity configured to hold a volume of a liquid; (ii) a holding sump including a holding cavity; (iii) a first supply line coupled between the liquid reservoir and the holding sump, wherein the supply line allows the liquid to flow to the holding cavity of the holding sump; (iv) a testing sump including a testing cavity, wherein the testing cavity is configured to receive one or more devices for testing; (v) a second supply line coupled between the holding sump and the testing sump, wherein the second supply line allows the liquid to flow from the holding cavity of the holding sump to the testing cavity of the testing sump; (vi) a return line coupled between the testing sump and the liquid reservoir, wherein the return line allows the liquid to flow from the testing cavity of the testing sump to the supply cavity of the liquid reservoir; and/or (vii) a monitoring device configured to communicate with the one or more devices and to collect testing data representing an operation of the one or more devices. The system may include additional, less, or alternate features, components, and functionality, including that discussed elsewhere herein.

In one aspect, a computer-implemented method for testing water mitigation equipment may be provided. The method may be implemented via one or more local or remote processors, transceivers, sensors, servers, memory units, mobile devices, wearables, virtual reality headsets, augmented reality or smart glasses, and/or other electronic or electric components, which may be wired or wireless communication with one another. In one instance, the method may include (such as via one or more local or remote processors and associated transceivers) (i) initiating a flow of a liquid from a holding sump into a testing sump, wherein the testing sump includes a testing cavity and one or more devices for testing positioned within the testing cavity; (ii) receiving test data from the one or more devices; (iii) determining that the one or more devices pass or fail water mitigation based at least partially on the test data; and/or (iv) outputting a pass or fail result for the one or more devices. The method may include additional, less, or alternate functionality, including that discussed elsewhere herein.

This summary is provided to introduce a selection of concepts in a simplified form that are further described in the Detailed Descriptions. This summary is not intended to identify key features or essential features of the claimed subject matter, nor is it intended to be used to limit the scope of the claimed subject matter.

Advantages will become more apparent to those of ordinary skill in the art from the following description of the preferred aspects, which have been shown and described by way of illustration. As will be realized, the present aspects may be capable of other and different aspects, and their details are capable of modification in various respects. Accordingly, the drawings and description are to be regarded as illustrative in nature and not as restrictive.

Figure 1:
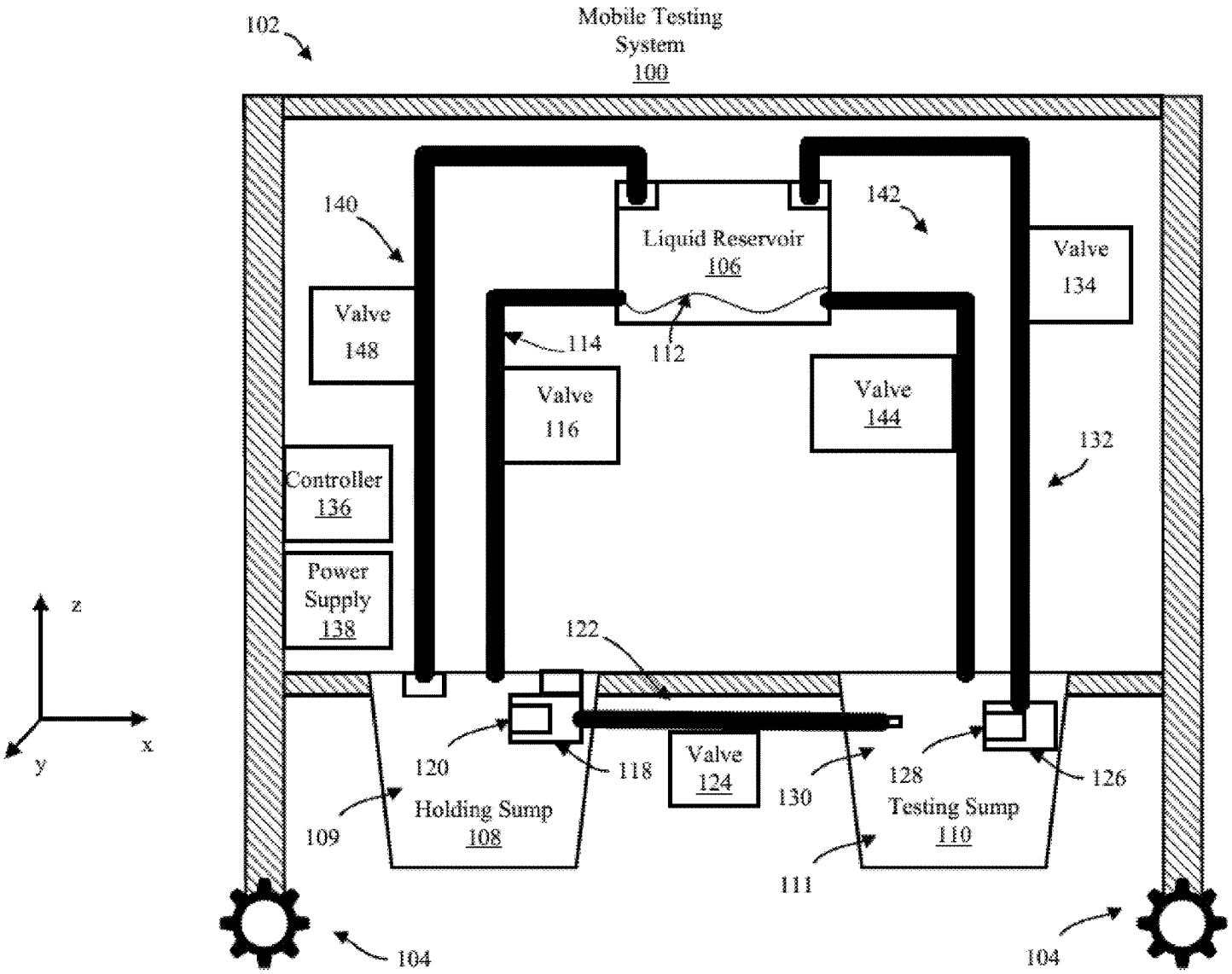
FIG. 1 depicts an exemplary mobile testing system, in accordance with various aspects of the present disclosure.

The figures depict preferred embodiments for purposes of illustration only. One skilled in the art will readily recognize from the following discussion that alternative embodiments of the systems and methods illustrated herein may be employed without departing from the principles of the invention described herein.

DETAILED DESCRIPTION

Techniques, systems, apparatuses, components, devices, and methods are disclosed for, inter alia, testing sump pumps and sensors in a simulated water intrusion environment. In general, a sump may typically refer to a pit or reservoir designed to collect and contain liquids, especially water. The sump may commonly be found in basements or crawl spaces of structures (e.g., houses or office buildings) and may serve the purpose of managing groundwater or preventing flooding. The sump pump may be an electric or hydraulic device that removes water from the sump pit and redirects the water away from the structure, usually through a drainage system.

In operation, the sump pump may activate automatically when water reaches a certain level in the sump pit. The combination of the sump pit and sump pump may prevent water damage by pumping out the excess water and maintaining the water level below a certain threshold. The sump pump may generally be equipped with water level sensors (e.g., float switches or pressure sensors) to activate the sump pump when water levels rise and deactivate the sump pump when the water is sufficiently drained.

As such, sump pumps may be useful in areas with high water tables, heavy rainfall, or buildings located in flood-prone regions. By efficiently removing water from the sump pit, sump pumps may aid in preventing basement flooding, dampness, and mold growth. Because of their critical function in preventing water intrusion, it may be important to maintain and regularly test sump pumps and sensors to ensure they are in proper working condition. The testing may include testing prior to deployment or certification to ensure the sump pumps and sensors may be relied upon by consumers.

Aspects of the present disclosure may provide a mobile testing system that simulates the real-world conditions of water intrusion into a structure. The mobile testing system may provide a simulated environment for testing water mitigation equipment (e.g., sump pumps and sensor) that does not require installation in a structure. The mobile testing system may provide a staged delivery of a liquid (e.g., water) that simulates the intrusion of water into a structure. The mobile testing system may include a liquid reservoir, first sump or well, and a second sump or well. The liquid reservoir may supply the liquid to the first sump or well, for example, by gravity. The first sump or well may act as a holding area of the water prior to delivery to the second sump or well. The second sump or well may operate as the testing environment of the mobile testing system. The liquid may then be flowed back to the reservoir for reuse in the mobile testing system. As such, the mobile testing system may provide a closed-loop environment that simulates water intrusion in a structure. The use of the dual-stage water delivery may provide an accurate simulation of the entry of the liquid into a structure.

One or more devices for testing (e.g., sump pumps or sensors) may be placed into the second sump or well. As water is flowed from the first sump or well, the one or more device for testing may be monitored. For example, testing data from the operation of the one or more devices for testing may be collected and analyzed to determine operation of the one or more devices. As such, the one or more devices may be tested and verified without the requirement of installing the devices in a real-world structure.

FIG. 1 depicts a block diagram of an exemplary mobile testing system 100 in which sump pumps and/or sensors may be tested in simulated water intrusion environments, in accordance with various aspects discussed herein. While FIG. 1 illustrates various components and systems that may be included in the mobile testing system 100, additional or alternative components and systems may be added, and components and systems that are illustrated may be removed.

The mobile testing system 100 may operate to simulate water intrusion into a structure. The mobile testing system 100 may allow the testing of water mitigation equipment such as sump pumps and sensors. The mobile testing system 100 may simulate actual conditions in a structure which allows testing of the water mitigation equipment without installation in an actual structure.

As illustrated in FIG. 1, the mobile test system 100 may include a scaffolding 102 that houses and supports equipment for simulating water intrusion conditions in a structure. The scaffolding 102 may be constructed of a rigid material that may support the weight of the scaffolding 102 and the testing components and equipment. The scaffolding 102 may be constructed of any suitable material, for example, metals, metal alloys, composite materials, and the like. The scaffolding 102 may include wheels or casters 104 that are coupled to the bottom surfaces of the scaffolding 102. The wheels or casters 104 may allow the mobile testing system 100 to be moved and transported.

The mobile testing system 100 may include a liquid reservoir 106, a holding sump 108, and a testing sump 110 that may be used in the water intrusion simulation. The liquid reservoir 106 may include a cavity that operates to hold water or other liquid 112 and supply the liquid to the holding sump 108 and the testing sump 110. In an embodiment, the liquid reservoir 106 may be located at a higher gravitational potential position, for example, in the z-direction as illustrated in FIG. 1, relative to the holding sump 108 and the testing sump 110. In this embodiment, the liquid 112 may be supplied by gravitational force. The liquid reservoir 106 may be a tank or other device that holds and stores the liquid 112 and may be constructed of any suitable material, for example, metals, metal alloys, composite materials, and the like.

The holding sump 108 and the testing sump 110 may operate to provide a cavity or volume for holding varying levels of the liquid 112 and provide a testing area for sump pumps and sensors. In embodiments, the holding sump 108 and the testing sump 110 may operate as a two-stage testing environment that controls the flow of the liquid 112 so that the mobile test system 100 accurately simulates water intrusion conditions in a structure. That is, the holding sumps may operate a sequestering pool, designated as the penstock, which is a sluice, gate, or intake structure that controls water flow. Once the holding sump 108 is over topped at a highwater mark, excess water may cross through an equalization tube to gently fall into the testing sump 110, simulating real-life water intrusion condition in a structure.

The holding sump 108 and the testing sump 110 may be constructed as a containment space having at least one opening for receiving the liquid 112. The holding sump 108 may include a holding cavity 109 for holding a portion of the liquid 112. The testing sump 110 may include a testing cavity 111 for holding a portion of the liquid 112. In an embodiment, the holding sump 108 and the testing sump 110 may be sump pits or wells that may be installed in structures. The holding sump 108 and the testing sump 110 may be constructed of any suitable material, for example, metals, metal alloys, composite materials, and the like.

The liquid reservoir 106 may be coupled to the holding sump 108 by a supply line 114. The supply line 114 may operate to allow the liquid 112 to flow from the liquid reservoir 106 to the holding sump 108. The supply line 114 may be constructed of any suitable material, for example, metals, metal alloys, composite materials, and the like. A valve 116 may be coupled to the supply line 114 to control the flow of liquid from the liquid reservoir 106 to the holding sump 108. The valve 116 may be any type of flow control device that regulates the flow of fluids within the supply line 114. For example, the valve 116 may be a mechanical valve (e.g., ball valve, gate valve, butterfly valve), an electro-mechanical valve (e.g., solenoid valve), hydraulic valve, and the like.

The holding sump 108 may include a supply pump 118 that is positioned within the holding sump 108. The holding sump 108 may be coupled to the testing sump 110 by a test supply line 122. The test supply line 122 may operate to allow liquid to flow from the holding sump 108 to the testing sump 110. The test supply line 122 may be constructed of any suitable material, for example, metals, metal alloys, composite materials, and the like. A valve 124 may be coupled to the test supply line 122 to control the flow of liquid from the holding sump 108 to the testing sump 110. The valve 124 may be any type of flow control device that regulates the flow of fluids within the supply line 122. For example, the valve 124 may be a mechanical valve (e.g., ball valve, gate valve, butterfly valve), an electro-mechanical valve (e.g., solenoid valve), hydraulic valve, and the like.

In some embodiments, the test supply line 122 may be disposed between the holding sump 108 and the testing sump 110 as a horizontal path between the sumps at a level that allows a flow of liquid between the sumps without use of a supply pump 118. In such embodiments, the test supply line 122 may be a tube functioning as a crossover path for liquid to move between the holding sump 108 and the testing sump 110, which path may be opened or closed by operation of the valve 124 in some such embodiments.

In some embodiments, the supply pump 118 may be coupled to a proximal end of the test supply line 122 located within the holding sump 108. The supply pump 118 may operate to supply a force to cause the liquid to flow from the holding sump 108 to the testing sump 110 through the test supply line 122. The supply pump 118 may be any type of electro-mechanical fluid pump capable of causing the flow of liquid through the test supply line 122. In an embodiment, the supply pump 118 may be a sump pump under test. The holding sump 108 may also include one or more sensors 120. The one or more sensors 120 may be configured to monitor the liquid conditions within the holding sump 108. For example, the one or more sensors 120 may monitor the liquid level within the holding sump 108 to allow activation of the supply pump 118.

The testing sump 110 may operate as a testing location for one or more water mitigation devices, for example, a sump pump 126, which may include a sensor 128. The supply pump 118 may be any type of pump that is configured to remove liquids (e.g., water) from a structure. The sensor 128 may be any type of sensor that operates in conjunction with the sump pump, for example, a liquid level sensor. The testing sump 110 may include additional equipment to be tested, for example, a stand-alone sensor 130. The stand-alone sensor 130 may be any type of sensors that detects water intrusion, monitors a sump pump, records and tracks environmental conditions (e.g., temperature, humidity, etc.), detects motion, captures still or moving images, detects electronic magnetic radiation, and the like.

The liquid reservoir 106 may be coupled to the testing sump 110 by a return line 132. The return line 132 may operate to allow the liquid 112 to flow from the testing sump 110 to the liquid reservoir 106. As such, the liquid reservoir 106, the holding sump 108, and the testing sump 110 form a closed loop in which the liquid 112 re-cycled through the system. In an embodiment, the sump pump 126 may be coupled to a proximal end of the return line 132 located within the testing sump 110. The sump pump 126 may operate to supply a force to cause the liquid to flow from the testing sump 110 to the liquid reservoir 106 through the return line 132. The return line 132 may be constructed of any suitable material, for example, metals, metal alloys, composite materials, and the like.

A valve 134 may be coupled to the return line 132 to control the flow of liquid from the testing sump 110 to the liquid reservoir 106. The valve 134 may be any type of flow control device that regulates the flow of fluids within the return line 132. For example, the valve 134 may be a mechanical valve (e.g., ball valve, gate valve, butterfly valve), an electro-mechanical valve (e.g., solenoid valve), hydraulic valve, and the like. In an embodiment, the valve 134 may be a one-way valve that selectively allows fluid flow in one direction. In further embodiments, the valves 124 and 134 may be configured to divert a flow of liquid from the usual course back to one of the sumps or to a drain, thus avoiding a pressure increase in the respective lines due to operation of the respective pumps.

The mobile testing system 100 may also include a controller 136. The controller 136 may be coupled to and/or communicate with one or more components of the mobile testing system 100. For example, the controller 136 may be coupled to one or more of the valve 116, the supply pump 118, the one or more sensors 128, the valve 124, the sump pump 126, the sensor 128, the stand-alone sensor 130, and the valve 134. The controller 136 may be configured to control the operation of the components of the mobile testing system 100. The controller 136 may be configured to monitor the operation of the components of the mobile testing system 100.

The mobile testing system 100 may also include a power supply 138. The power supply 138 may be coupled to the components of the mobile testing system 100 that require power. The power supply 138 may be a device that provide power directly to the components of the mobile testing station. For example, the power supply 138 may include a one or more batteries, one or more generators, one or more solar cells, etc. the power supply 138 may be a device that transfers power to the components of the mobile testing station for an external power source. For example, the power supply 138 may include one or more transformers, one or more breakers, one or more outlet device, etc.

In aspects, the mobile testing system 100 may operate in a mode that allows the holding sump 108 and the testing sump 110 to receive the liquid 112 independently. The mobile testing system 100 may include a secondary return line 140. The liquid reservoir 106 may be coupled to the holding sump 108 by the secondary return line 140. The secondary return line 140 may operate to allow the liquid 112 to flow from the holding sump 108 to the liquid reservoir 106. As such, the liquid reservoir 106 and the holding sump 108 may form a closed loop independent of the testing sump 110. A secondary pump or the supply pump 118 may operate to supply a force to cause the liquid to flow from the holding sump 108 to the liquid reservoir 106 through the secondary return line 140. The secondary return line 140 may be constructed of any suitable material, for example, metals, metal alloys, composite materials, and the like. A valve 148 may be coupled to the secondary return line 140 to control the flow of liquid from the holding sump 108 to the liquid reservoir 106. The valve 148 may be any type of flow control device that regulates the flow of fluids within the secondary return line 140. For example, the valve 148 may be a mechanical valve (e.g., ball valve, gate valve, butterfly valve), an electro-mechanical valve (e.g., solenoid valve), hydraulic valve, and the like. In an embodiment, the valve 148 may be a one-way valve that selectively allows fluid flow in one direction.

The liquid reservoir 106 may be coupled to the testing sump 110 by a secondary supply line 142. The secondary supply line 142 may operate to allow the liquid 112 to flow from the liquid reservoir 106 to the testing sump 110. As such, the liquid reservoir 106 and the testing sump 110 may form a closed loop independent of the holding sump 108. The secondary supply line 142 may be constructed of any suitable material, for example, metals, metal alloys, composite materials, and the like. A valve 144 may be coupled to the secondary supply line 142 to control the flow of liquid from the liquid reservoir 106 to the testing sump 110. The valve 144 may be any type of flow control device that regulates the flow of fluids within the secondary supply line 142. For example, the valve 144 may be a mechanical valve (e.g., ball valve, gate valve, butterfly valve), an electro-mechanical valve (e.g., solenoid valve), hydraulic valve, and the like.

For example, the mobile testing system 100 may operate in an independent mode. The holding sump 108 and the testing sump 110 may include different types of water mitigation equipment that run independently thereby allowing side-by-side comparison. For instance, the holding sump 108 may include an emergency back-up sump pump powered by a battery, and the testing sump 110 may include an emergency back-up sump that is water driven. This allows different types of water mitigation equipment to be operated simultaneously for demonstration and testing. In another example, the mobile testing system 100 may operate in a demonstration mode. In this example, the mobile testing system 100 may operate as a physical display that demonstrates an operation of the water mitigation devices in structural water removal systems.

Figure 2:
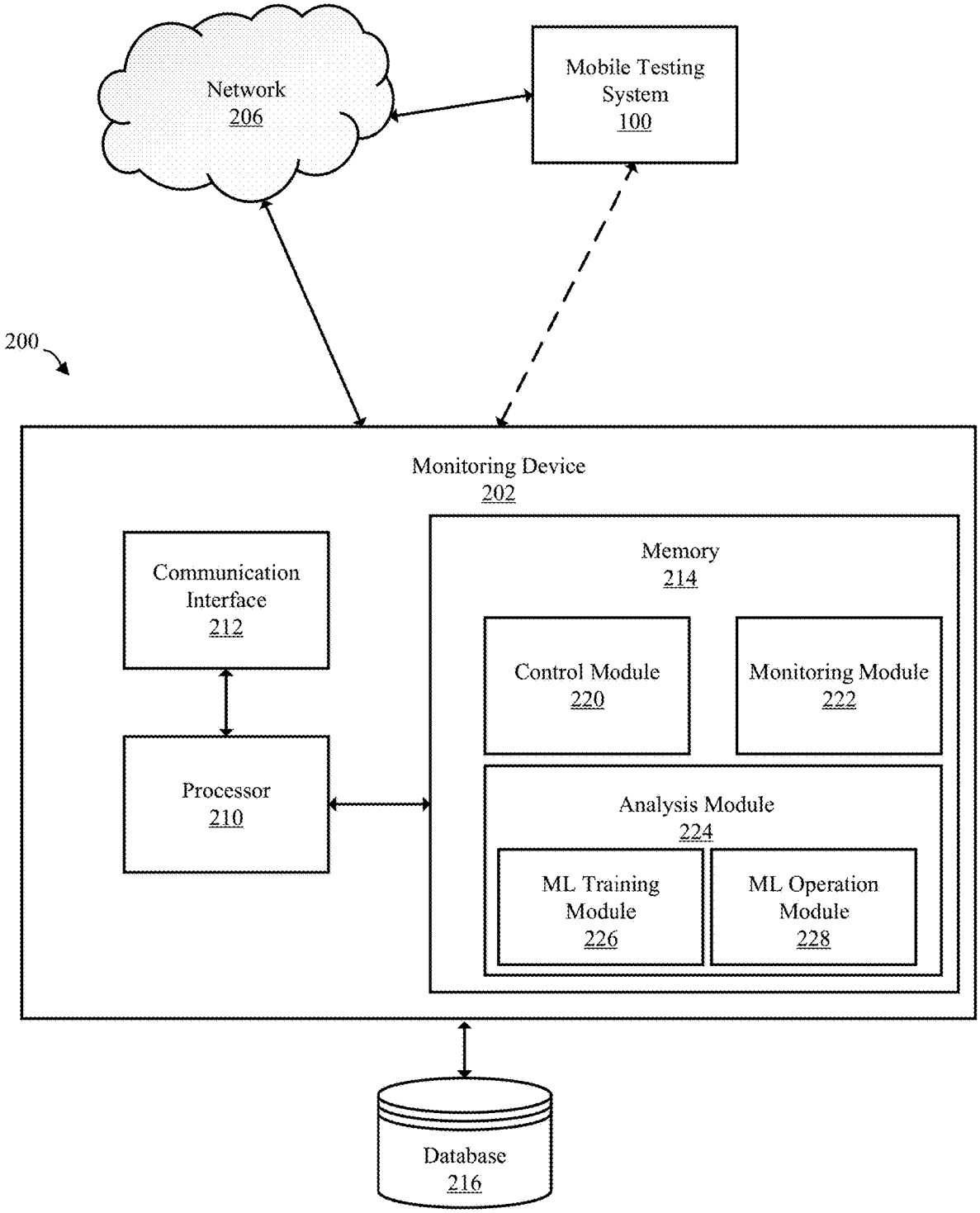
FIG. 2 depicts an exemplary monitoring environment, including the mobile testing system, in accordance with various aspects of the present disclosure.

FIG. 2 depicts a block diagram of a monitoring environment 200 in which sump pumps and/or sensors may be tested in simulated water intrusion environments, in accordance with various aspects discussed herein. While FIG. 2 illustrates various components, systems, and entities that may be included in the monitoring environment 200, additional or alternative components, systems, and entities may be added, and components, systems, and entities that are illustrated may be removed.

The monitoring environment 200 may include the mobile testing system 100 and a monitoring device 202. The monitoring device 202 may operate to collect test data from the water mitigation equipment that is under test in the mobile testing system 100. The monitoring device 202 may operate to analyze the test data collected from the water mitigation equipment. The monitoring environment 200 may further include one or more electronic networks 206 communicatively coupling the monitoring device 202 to the one or more electronic networks 206.

The monitoring device 202 may be any suitable computing device and include one or more Internet of Things (IoT) hubs, mobile devices, wearables, smart watches, smart contact lenses, smart glasses, AR glasses/headsets, virtual reality (VR) glasses/headsets, mixed or extended reality glasses/headsets, voice bots or chatbots, ChatGPT bots, displays, display screens, visuals, and/or other electronic or electrical component. The monitoring device 202 may include a memory 214 and a processor 210 for, respectively, storing and executing one or more modules, for example, a control module 220 and a monitoring module 222. The memory 214 may include one or more suitable storage media such as a magnetic storage device, a solid-state drive, random access memory (RAM), etc. The monitoring device 202 may access services or other components of the monitoring environment 200 via the one or more networks 206. The monitoring device 202 may communicate with and/or control the components of the mobile testing system 100 via the one or more networks 206.

The one or more networks 206 may include any suitable network or networks, including a local area network (LAN), wide area network (WAN), Internet, or combination thereof. For example, the one or more networks 206 may include a wireless cellular service (e.g., 4G, 5G, 6G, etc.). Generally, the one or more networks 206 may enable bidirectional communication between the monitoring device 202 and the mobile testing system 100. In one aspect, the one or more networks 206 may include a cellular base station, such as cell tower(s), communicating to the one or more components of the monitoring device 202 and/or the mobile testing system 100 via wired/wireless communications based on any one or more of various mobile phone standards, including NMT, GSM, CDMA, UMTS, LTE, 5G, 6G, or the like. Additionally or alternatively, the one or more networks 206 may comprise one or more routers, wireless switches, or other such wireless connection points communicating to the components of the monitoring environment 200 via wireless communications based on any one or more of various wireless standards, including by non-limiting example, IEEE 802.11a/b/g/n/ac/ax/be (WIFI), Bluetooth, and/or the like. In some embodiments, the one or more networks 206 may include a direct electrical connection to one or more of the components of the mobile testing system 100.

The processor 210 may include one or more suitable processors (e.g., central processing units (CPUs) and/or graphics processing units (GPUs)). The processor 210 may be connected to the memory 214 via a computer bus (not depicted) responsible for transmitting electronic data, data packets, or otherwise electronic signals to and from the processor 210 and memory 214 in order to implement or perform the machine-readable instructions, methods, processes, elements or limitations, as illustrated, depicted, or described for the various flowcharts, illustrations, diagrams, figures, and/or other disclosure herein. The processor 210 may interface with the memory 214 via a computer bus to execute an operating system (OS) and/or computing instructions contained therein, and/or to access other services/ aspects. For example, the processor 210 may interface with the memory 214 via the computer bus to create, read, update, delete, or otherwise access or interact with the data stored in the memory 214 and/or a database 216.

The memory 214 may include one or more forms of volatile and/or non-volatile, fixed and/or removable memory, such as read-only memory (ROM), electronic programmable read-only memory (EPROM), random access memory (RAM), erasable electronic programmable read-only memory (EEPROM), and/or other hard drives, flash memory, MicroSD cards, and others. The memory 214 may store an operating system (OS) (e.g., Microsoft Windows, Linux, UNIX, MacOS, etc.) capable of facilitating the functionalities, apps, methods, or other software as discussed herein.

The memory 214 may store a plurality of computing modules, for example, the control module 220, the monitoring module 222, and the analysis module 224, implemented as respective sets of computer-executable instructions (e.g., one or more source code libraries, trained ML models such as neural networks, convolutional neural networks, etc.) as described herein.

In general, a computer program or computer based product, application, or code (e.g., the model(s), such as ML models, or other computing instructions described herein) may be stored on a computer usable storage medium, or tangible, non-transitory computer-readable medium (e.g., standard random access memory (RAM), an optical disc, a universal serial bus (USB) drive, or the like) having such computer-readable program code or computer instructions embodied therein, wherein the computer-readable program code or computer instructions may be installed on or otherwise adapted to be executed by the processor 210 (e.g., working in connection with the respective operating system in memory 214) to facilitate, implement, or perform the machine readable instructions, methods, processes, elements or limitations, as illustrated, depicted, or described for the various flowcharts, illustrations, diagrams, figures, and/or other disclosure herein. In this regard, the program code may be implemented in any desired program language, and may be implemented as machine code, assembly code, byte code, interpretable source code or the like (e.g., via Golang, Python, C, C++, C#, Objective-C, Java, Scala, ActionScript, JavaScript, HTML, CSS, XML, etc.).

The database 216 may be a relational database, such as Oracle, DB2, MySQL, a NoSQL based database, such as MongoDB, or another suitable database. The database 216 may store data and be used to train and/or operate one or more ML models, chatbots, and/or voice bots.

As described herein and in an aspect, the functionality of the monitoring device 202 may be embodied in one or more servers. The one or more servers may perform the functionalities as part of a cloud network or may otherwise communicate with other hardware or software components within one or more cloud computing environments to send, retrieve, or otherwise analyze data or information described herein. For example, in certain aspects of the present techniques, the monitoring environment 200 may comprise an on-premise computing environment, a multi-cloud computing environment, a public cloud computing environment, a private cloud computing environment, and/or a hybrid cloud computing environment. For example, an entity (e.g., a business) providing a chatbot to enable remediation provider and/or insurance provider notification may host one or more services in a public cloud computing environment (e.g., Alibaba Cloud, Amazon Web Services (AWS), Google Cloud, IBM Cloud, Microsoft Azure, etc.). The public cloud computing environment may be a traditional off-premise cloud (i.e., not physically hosted at a location owned/controlled by the business). Alternatively, or in addition, aspects of the public cloud may be hosted on-premise at a location owned/controlled by the a structure owner or lessee. The public cloud may be partitioned using visualization and multi-tenancy techniques and may include one or more infrastructure-as-a-service (IaaS) and/or platform-as-a-service (PaaS) services.

In one aspect, the memory 214 may include the control module 220, the monitoring module 222, and the analysis module 224. The control module 220 may include the necessary logic to control the components of the mobile testing system 100 during testing operations. The control module 220 may provide instructions to the controller 136 for controlling the components of the mobile testing system 100. Likewise, for example, the control module 220 may provide instruction directly to the components of the mobile testing system 100. Instructions provided by the control module may include actuation of the valve 116, the valve 124, and the valve 134; operation of the supply pump 118; operation of equipment under test, and the like.

In one aspect, the computing modules may include the monitoring module 222, comprising a set of computer-executable instructions implementing communication functions. The monitoring module 222 may operate to communicate with the water mitigation equipment being tested in the mobile testing system 100 (e.g., the sump pump 126, the sensor 128, the stand-alone sensors 130, etc.) and retrieve/receive testing data that reflects the operation of the water mitigation equipment. The testing data may include any electronic data that may be collected and transmitted by the water mitigation equipment being tested in the mobile testing system 100 (e.g., the sump pump 126, the sensor 128, the stand-alone sensors 130, etc.). For example, the testing data may include liquid level data, power usage data, activation time data, operating time data, liquid flow rate data, pressure data, temperate data, error message data, images, video, and the like.

The monitoring module 222 may include a communication component configured to communicate (e.g., send and receive) data via one or more external/network port(s) to one or more networks or local terminals, such as the one or more networks 206 and/or the mobile testing system 100 (for rendering or visualizing) described herein. In one aspect, the monitoring module 222 may include a client-server platform technology such as ASP.NET, Java J2EE, Ruby on Rails, Node.js, a web service or online API, responsive for receiving and responding to electronic requests.

The monitoring module 222 may further include or implement an operator interface configured to present information to an administrator or operator and/or receive inputs from the administrator and/or operator. An operator interface may provide a display screen. The monitoring module 222 may facilitate I/O components (e.g., ports, capacitive or resistive touch sensitive input panels, keys, buttons, lights, LEDs), which may be directly accessible via or may be indirectly accessible via or attached to the monitoring device 202. According to an aspect, an administrator or operator may access the monitoring device 202 to review information, make changes, input training data, initiate training via the analysis module 224, and/or perform other functions (e.g., operation of one or more trained models via the analysis module 224).

In one aspect, the control module 220, the monitoring module 222, and/or the analysis module 224 may include one or more natural language processing (NLP) modules comprising a set of computer-executable instructions implementing NLP, natural language understanding (NLU) and/or natural language generator (NLG) functionality. The NLP modules may be responsible for transforming the user input (e.g., unstructured conversational input such as speech or text) to an interpretable format. The NLP modules may include an NLU to understand the intended meaning of utterances and/or prompts, among other things. The NLP modules may include an NLG, which may provide text summarization, machine translation, and/or dialog where structured data is transformed into natural conversational language (i.e., unstructured) for output to the user.

In one aspect, the control module 220, the monitoring module 222, and/or the analysis module 224 may include one or more chatbots and/or voice bots. Voice bots or chatbots discussed herein may be configured to utilize AI and/or ML techniques. For instance, the voice bot or chatbot may be a ChatGPT chatbot or other ChatGPT-based bot. The voice bots or chatbots may generate human-like responses to text inputs and engage in conversations with users of the monitoring device 202. The voice bot or chatbot may employ supervised or unsupervised machine learning techniques, which may be followed by, and/or otherwise used in conjunction with, reinforced or reinforcement learning techniques. The voice bot or chatbot may employ the techniques utilized for ChatGPT. The voice bot or chatbot may deliver various types of output for user consumption in certain embodiments, such as verbal or audible output, a dialogue output, text or textual output (such as presented on a computer or mobile device screen or display), visual or graphical output, and/or other types of outputs.

The chatbot and/or voice bot may be programmed to simulate human conversation, interact with users, understand their needs, and recommend an appropriate line of action with minimal and/or no human intervention, among other things. The chatbot and/or voice bot may be any suitable chatbot and/or voice bot, such as a generative pre-trained transformer (GPT) chatbot. This may include providing the best response of any query that it receives and/or asking follow-up questions.

For example, a user may provide a request to the chatbot or voice bot, such as "Provide an analysis of the last sump pump and sensor test." The chatbot or voice bot may then generate an output indicating the results of the last test perform on the mobile testing system 100. For example, the chatbot or voice bot may provide a response to the request which includes an identification of the sump pump and sensor being tested, parameters of the test, and/or data indicating how the sump pump and sensor performed.

In certain embodiments, the voice bots or chatbots discussed herein may be configured to utilize AI and/or ML techniques. For instance, the voice bot or chatbot may be a ChatGPT chatbot. The voice bot or chatbot may employ supervised or unsupervised machine learning techniques, which may be followed by, and/or used in conjunction with, reinforced or reinforcement learning techniques. The voice bot or chatbot may employ the techniques utilized for ChatGPT.

Noted above, in some embodiments, a chatbot or other computing device may be configured to implement algorithms and/or machine-learning (ML) models, such that the chatbot or other computing device "learns" to analyze, organize, and/or process data without being explicitly programmed. ML may be implemented through ML methods and algorithms ("ML methods and algorithms").

For example, in an aspect, the monitoring device 202 may initiate a chat session over the network 206 with a user via the user device, e.g., so the user may initiate a test on the mobile testing system 100 and/or request an analysis of the test data. The chatbot may receive utterances from the user, i.e., the input from the user from which the chatbot needs to derive intents from. The utterances may be processed using the NLP module and/or an ML module via one or more ML models to recognize what the user says, understand the meaning, determine the appropriate action, and/or respond with language the user may understand.

In some embodiments, the ML chatbot may be based upon a large language model (LLM). Such an LLM may be trained to predict a word in a sequence of words. For example, the LLM may be trained to predict a next word following a given sequence of words (e.g., "next-token-prediction"), and/or trained to predict a "masked" (e.g., hidden) word within a sequence of given sequence of words (e.g., "masked-language-modeling"). For instance, in an example of next-token-prediction, the ML chatbot may be given the sequence "Jane is a"—and the ML chatbot may predict a next word, such as "dentist," "teacher," "mother," etc. In an example of masked-language-modeling, the ML chatbot may receive the given the sequence "Jane XYZ skiing"—and the ML chatbot may fill in XYZ with "loves," "fears," "enjoys," etc.

In some embodiments, this prediction technique may be accomplished through a long-short-term-memory (LSTM) model, which may fill in the blank with the most statistically probable word based upon surrounding context. However, the LSTM model may have the following two drawbacks. First, the LSTM model may not rate/value individual surrounding words more than others. For instance, in the masked-language-modeling example of the preceding paragraph, skiing may most often be associated with "enjoys;" however Jane in particular, may fear skiing, but the LSTM model may not be able to correctly determine this. Second, instead of being processed as a whole, the words of the input sequence may be processed individually and sequentially, thus restricting the complexity of the relationships that may be inferred between words and their meanings.

Advantageously, some embodiments overcome these drawbacks of the LSTM model by using transformers (e.g., by using a generative pre-trained transformer (GPT) model). More specifically, some embodiments use a GPT model that includes (i) an encoder that processes the input sequence, and (ii) a decoder that generates the output sequence. The encoder and decoder may both include a multi-head self-attention mechanism that allows the GPT model to differentially weight parts of the input sequence to infer meaning and context. In addition, the encoder may leverage masked-language-modeling to understand relationships between words and produce improved responses.

Such multi-head self-attention mechanism may convert tokens (e.g., strings of text, such as a word, sentence, grouping of text, etc.) into vectors representing the importance of the token in the input sequence. In some embodiments, to accomplish this, the GPT model may perform the following steps. First, query, key, and value vectors may be created for each token in the input sequence. Second, a similarity between the query vector for the token and the key vector of every other token may be calculated by taking the dot product of the two vectors. Third, normalized weights may then be generated by feeding the output of the previous step into a softmax function. Fourth, a final vector may be generated; the final vector may represent the importance of the token within the input sequence by multiplying the weights generated in the previous step by the value vectors of each token.

Furthermore, in some embodiments, rather than performing the previous four steps only once, the GPT model may iterate the steps and performs them in parallel; at each iteration, new linear projection of the query, key, and value vectors may be generated. Such iterative, parallel embodiments advantageously may improve grasping of sub-meanings and more complex relationships within the input sequence data.

Further advantageously, some embodiments may first train a basic model (e.g., a basic GPT model, etc.), and subsequently may perform any of the following three steps on the basic model: supervised fine tuning (SFT); reward modeling; and/or reinforcement learning.

In the SFT step, a supervised training dataset may be created. The supervised training dataset may have known outputs for each input so that the model may learn from the correspondences between input and outputs. For example, to train the model to generate summaries of data security scores, the supervised training dataset may have: (a) inputs of (i) data security scores, and/or (ii) data security grades; and (b) outputs summarizing the data security scores and/or grades. The supervised training dataset may be received (e.g., by the voice bot or chatbot) from any source (or combination of sources).

Training the basic model on the supervised training dataset may create the SFT model; and, subsequent to creating the SFT model, a chatbot training application may perform reward modeling. In reward modeling, the SFT may be fed input prompts, and may output multiple outputs (e.g., 2-10 outputs, etc.) for each input. The multiple outputs for each input may be achieved by, for example, randomness, or by controlling a predictability setting. A user (e.g., an administrator, an operator, etc.) may then rank the multiple outputs for each input, thus allowing the model to associate each output with a reward (e.g., a scalar value). And the ranked outputs may then be used to further train the SFT model. For instance, the SFT model may receive an input of a data security score and create seven outputs summarizing the score; the administrator may then rank the seven output summaries; and the rankings may then be fed back into the model to further train the model. Via this reward modeling step, the chatbot training application may create a policy that the model learns. The policy may comprise a strategy for the model to maximize its reward.

Subsequently, the chatbot training application may further train the model via reinforcement learning. Here, further inputs may be fed into the model, and the model then generates, based upon the policy learned during reward modeling, (i) outputs corresponding to the inputs, and (ii) rewards values (e.g., scalar values) corresponding to the input/output pairs. The rewards values may then be fed back into the model to further evolve the policy. In some embodiments, the reward modeling and reinforcement learning steps may be iterated through any number of times.

The analysis module 224 may operate to analyze the test data collected from the equipment being tested in the mobile testing system 100. The analysis module 224 may employ various algorithms and/or ML models that analyze the test data and determine operational performance of the equipment being tested. The analysis module 224 may include ML training module (MLTM) 226 and/or ML operation module (MLOM) 228. In some embodiments, at least one of a plurality of ML methods and algorithms may be applied by the analysis module 224, which may include, but are not limited to: linear or logistic regression, instance-based algorithms, regularization algorithms, decision trees, Bayesian networks, cluster analysis, association rule learning, artificial neural networks, deep learning, combined learning, reinforced learning, dimensionality reduction, and support vector machines. In various embodiments, the implemented ML methods and algorithms are directed toward at least one of a plurality of categorizations of ML, such as supervised learning, unsupervised learning, and reinforcement learning. In one aspect, the ML based algorithms may be included as a library or package executed on the monitoring device 202. For example, libraries may include the TensorFlow based library, the PyTorch library, the HuggingFace library, and/or the scikit-learn Python library.

In one embodiment, the analysis module 224 employs supervised learning, which involves identifying patterns in existing data to make predictions about subsequently received data. Specifically, the ML module is "trained" (e.g., via MLTM 226) using training data, which includes example inputs and associated example outputs. Based upon the training data, the ML training module may generate a predictive function which maps outputs to inputs and may utilize the predictive function to generate ML outputs based upon data inputs. The exemplary inputs and exemplary outputs of the training data may include any of the data inputs or ML outputs described above. In the exemplary embodiments, a processing element may be trained by providing it with a large sample of data with known characteristics or features.

In another embodiment, the analysis module 224 may employ unsupervised learning, which involves finding meaningful relationships in unorganized data. Unlike supervised learning, unsupervised learning does not involve user-initiated training based upon example inputs with associated outputs. Rather, in unsupervised learning, the analysis module 224 may organize unlabeled data according to a relationship determined by at least one ML method/algorithm employed by the analysis module 224. Unorganized data may include any combination of data inputs and/or ML outputs as described above.

In yet another embodiment, the analysis module 224 may employ reinforcement learning, which involves optimizing outputs based upon feedback from a reward signal. Specifically, the analysis module 224 may receive a user-defined reward signal definition, receive a data input, utilize a decision-making model to generate the ML output based upon the data input, receive a reward signal based upon the reward signal definition and the ML output, and alter the decision-making model so as to receive a stronger reward signal for subsequently generated ML outputs. Other types of ML may also be employed, including deep or combined learning techniques.

The MLTM 226 may receive labeled data at an input layer of a model having a networked layer architecture (e.g., an artificial neural network, a convolutional neural network, etc.) for training the one or more ML models. The received data may be propagated through one or more connected deep layers of the ML model to establish weights of one or more nodes, or neurons, of the respective layers. Initially, the weights may be initialized to random values, and one or more suitable activation functions may be chosen for the training process. The present techniques may include training a respective output layer of the one or more ML models. The output layer may be trained to output a prediction, for example.

The MLOM 228 may comprise a set of computer-executable instructions implementing ML loading, configuration, initialization and/or operation functionality. The MLOM 228 may include instructions for storing trained models (e.g., in the electronic database 216). As discussed, once trained, the one or more trained ML models may be operated in inference mode, whereupon when provided with de novo input that the model has not previously been provided, the model may output one or more predictions, classifications, etc., as described herein. ML may be implemented through the ML methods and algorithms. In one exemplary embodiment, the control module 220, the monitoring module 222, and/or the analysis module 224 may be configured to implement the ML.

In one aspect, the monitoring device 202 may host and/or provide an application (e.g., a mobile application), and/or a website configured to provide the application, to testing data and analysis from the monitoring device 202. In one aspect, the monitoring device 202 may store code in memory 214 which when executed by processor 210 may provide the website and/or application. In some embodiments, the testing data may indicate a repository, file location, and/or other data store at which the source code and/or privacy policy may be maintained. In some embodiments, the monitoring device 202 may store at least a portion of the sump pump and/or flood sensor data in the database 216. The testing data stored in the database 216 may be cleaned, labeled, vectorized, weighted and/or otherwise processed, especially processing suitable for data used in any aspect of ML.

In operation, the control module 220, the monitoring module 222, and/or the analysis module 224 may access database 216 or any other data source for training data suitable to generate one or more ML models appropriate to receive and/or process the testing data. The training data may be sample data with assigned relevant and comprehensive labels (classes or tags) used to fit the parameters (weights) of an ML model with the goal of training it by example. In one aspect, testing data may include historical data from testing session on the mobile testing platform. The testing data may also include historical data from the operation of water mitigation equipment in real-world settings, for example, recorded sump pump faults, data collected for sensors deployed in structures, and/or flood events. The historical data may include the testing data described above in addition to other data such as identification of manufacturers of the water mitigation equipment, service provider names, cost estimates for damage in flood events, schedule availabilities, as well as any other suitable training data. In one aspect, once an appropriate ML model is trained and validated to provide accurate predictions and/or responses, the trained model may be loaded into MLOM 228 at runtime, may process the testing data to provide output analysis of the equipment being tested and responses to inquiries made by the operators of the monitoring device.

While various embodiments, examples, and/or aspects disclosed herein may include training and generating one or more ML models for the monitoring device 202 to load at runtime, it is also contemplated that one or more appropriately trained ML models may already exist (e.g., in database 216) such that the monitoring device 202 may load an existing trained ML model at runtime. It is further contemplated that the monitoring device 202 may retrain, update and/or otherwise alter an existing ML model before loading the model at runtime.

Although the monitoring environment 200 is shown to include one monitoring device 202, it should be understood that different numbers of monitoring devices 202 may be utilized. In one example, the monitoring environment 200 may include a plurality of monitoring devices 202, all of which may be interconnected via the one or more networks 206. Furthermore, the database storage or processing performed by the monitoring device 202 may be distributed among a plurality of computer devices and system in an arrangement known as "cloud computing." This configuration may provide various advantages, such as enabling near real-time uploads and downloads of information as well as periodic uploads and downloads of information.

The monitoring environment 200 may include additional, fewer, and/or alternate components, and may be configured to perform additional, fewer, or alternate actions, including components/actions described herein. Although the monitoring environment 200 is shown in FIG. 2 as including one instance of various components such as the monitoring device 202, the one or more networks 206, and the mobile testing system 100, etc., various aspects include the monitoring environment 200 implementing any suitable number of any of the components shown in FIG. 2 and/or omitting any suitable ones of the components shown in FIG. 2. For instance, information described as being stored at database 216 may be stored at the memory 214, and thus database 216 may be omitted. Moreover, various aspects include the monitoring environment 200 including any suitable additional component(s) not shown in FIG. 2, such as but not limited to the exemplary components described above. Furthermore, it should be appreciated that additional and/or alternative connections between components shown in FIG. 2 may be implemented. As just one example, the monitoring device 202 may be connected via a direct communication link to the mobile testing system 100 instead of, or in addition to, via one or more networks 206.

Figure 3:
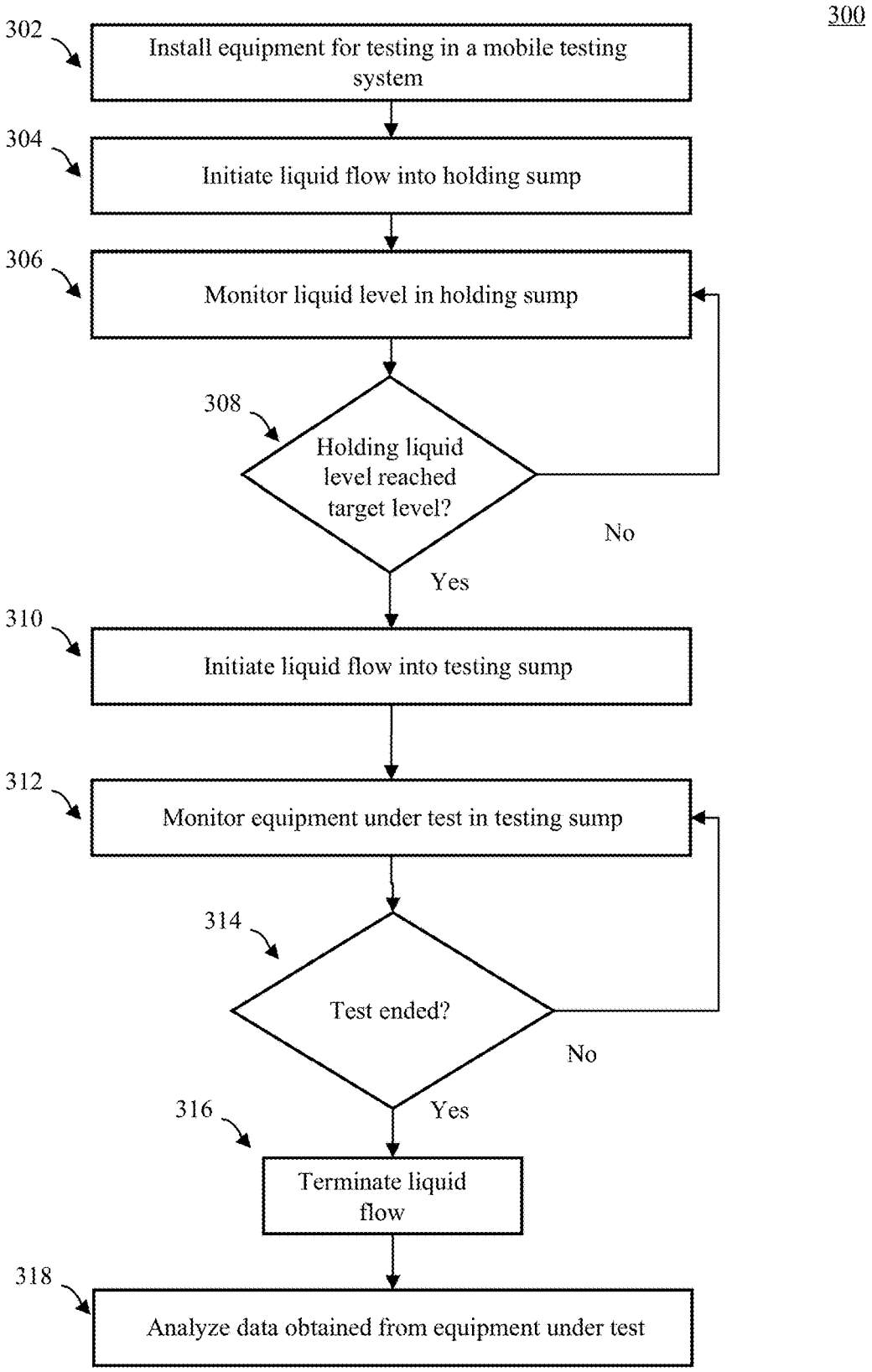
FIG. 3 depicts an exemplary process for simulating water intrusion for testing equipment, in accordance with various aspects of the present disclosure.

FIG. 3 is a flow diagram of an exemplary computer-implemented method 300 for simulating water intrusion condition and testing water mitigation equipment. Portions of the method 300 may be implemented by one or more processors of a computing system such as a computing device representing the monitoring device 202. Alternatively or additionally, the method 300 may be implemented by components of a distributed system such as the mobile testing system 100 and the monitoring device 202 as described with regard to FIGS. 1 and/or 2 above, or otherwise implemented by one or more local or remote processors, servers, sensors, transceivers, memory units, wearables, smart contacts, smart glasses, virtual reality headsets, augmented reality glasses or headsets, mixed or extended reality headsets or glasses, voice or chat bots, generative AI, and/or other electronic or electrical components, including those mentioned elsewhere herein.

At block 302, equipment for testing may be installed in mobile testing system. For example, referring to the mobile testing system 100 of FIG. 1, equipment to be tested may be installed in the testing cavity 111 of the testing sump 110. The equipment to be tested may include water mitigation equipment such as one or more sump pumps and one or more sensors that monitor the sump pumps or other data related to the water mitigation.

Figure 4A:
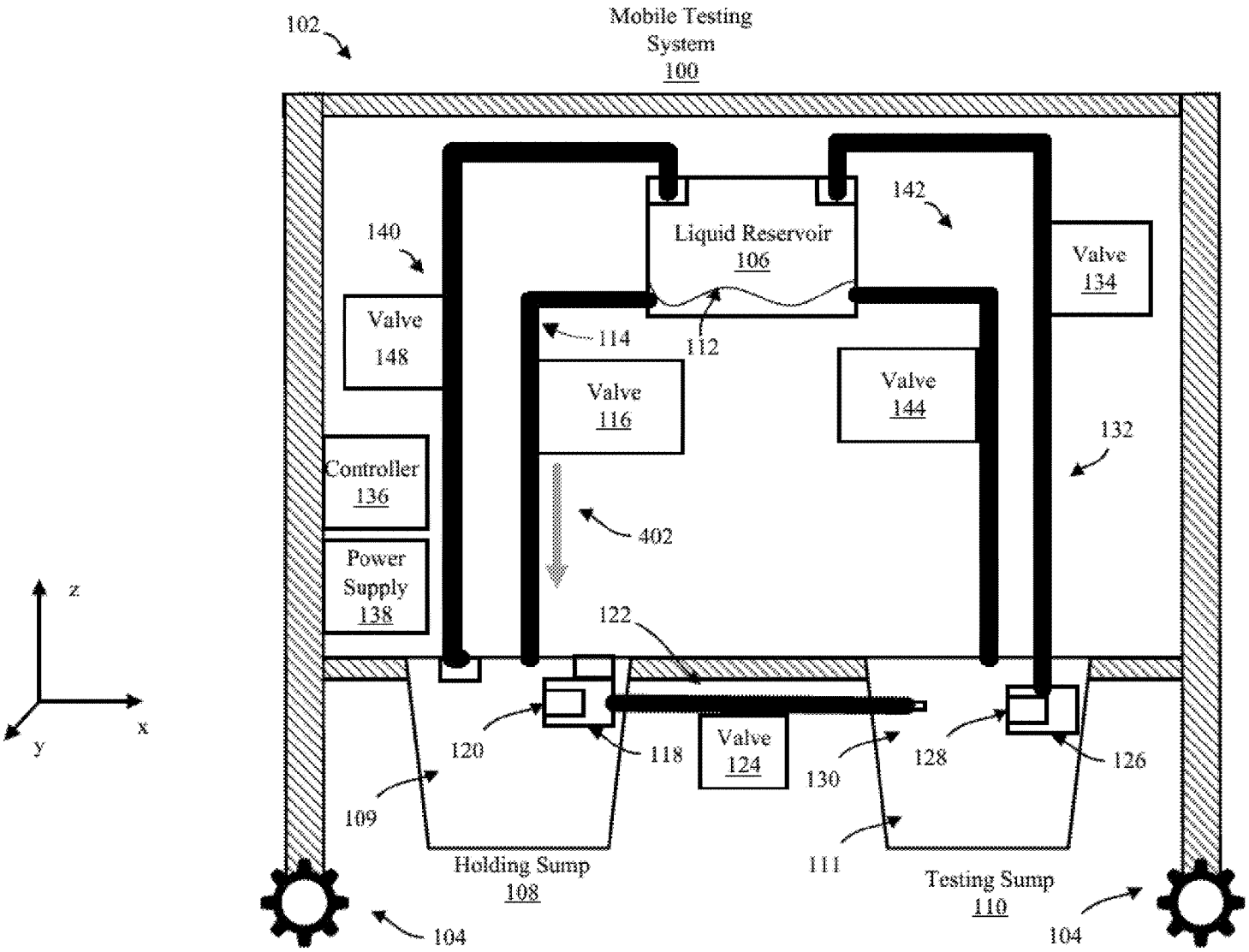
FIGS. 4A-4E depict an exemplary operation of the mobile testing system of FIG. 1, in accordance with various aspects of the present disclosure.

At block 304, a liquid flow may be initiated into a holding sump 108 of the mobile testing system 100. For example, as illustrated in FIG. 4A, the valve 116 may be actuated thereby opening the supply line 114. In response, a flow 402 of liquid 112 may begin from the liquid reservoir 106 to the holding cavity 109 of the holding sump 108. In an embodiment, the valve 116 may be actuated by the controller 136. In an embodiment, the valve 116 may be actuated by the monitoring device 202 by a command sent to the controller 136 and/or directly to the valve 116. In an embodiment, the valve 116 may be actuated manually by a user of the mobile testing system 100.

At block 306, liquid level in the holding sump 108 may be monitored. At block 308, it may be determined if the holding liquid level reaches a target level. For example, the sensor 120 may monitor the liquid level 404 in the holding cavity 109 of the holding sump 108. The sensor 120 may detect when the liquid level 404 reaches a target level, for example, covering the supply pump 118.

Figure 4B:
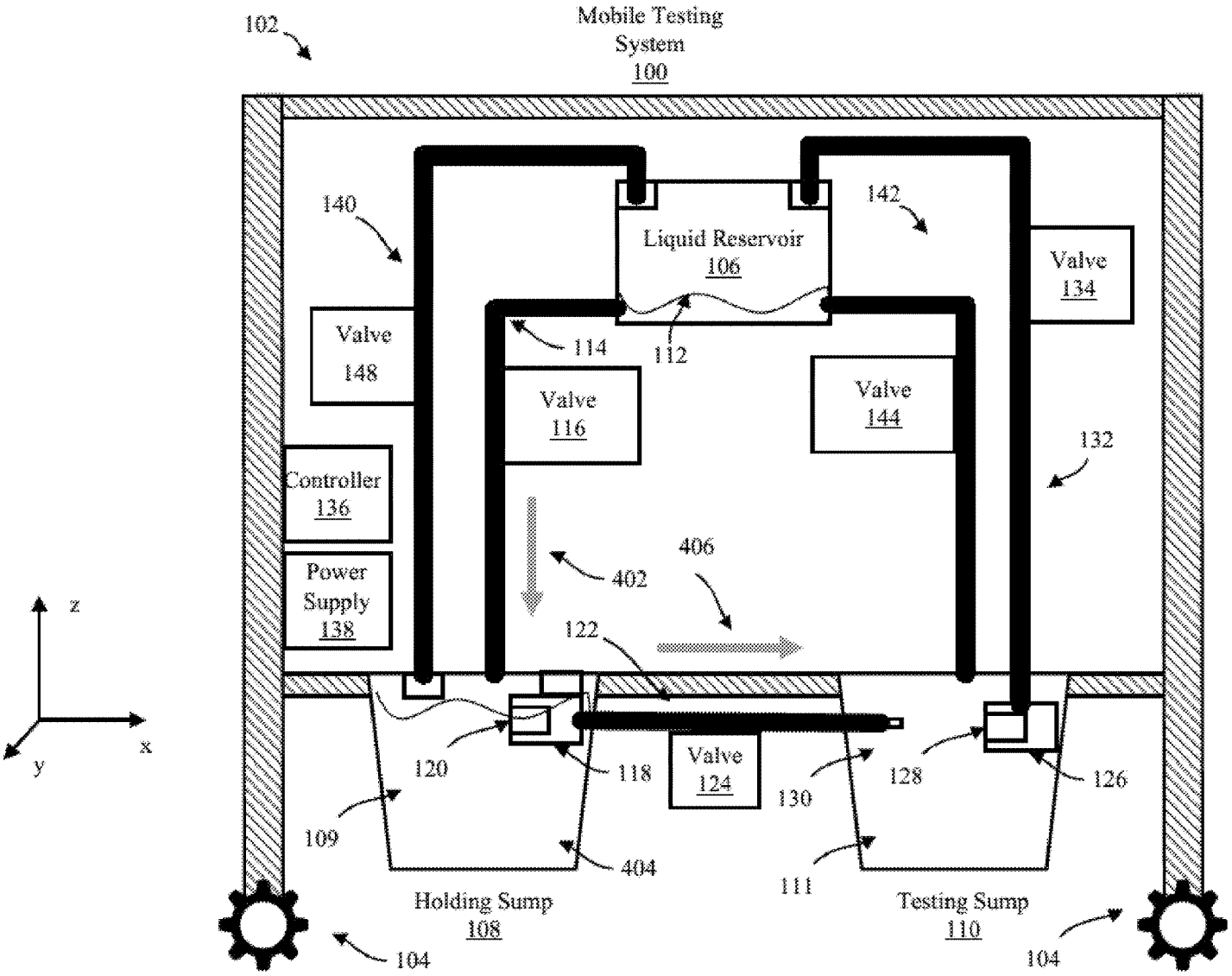

If the target level has not been reached, the method 300 may return to block 306 to continue monitoring the liquid level 404 in the holding sump 108. If the target level has been reached, at block 310, a liquid flow may be initiated into a testing sump 110 of the mobile testing system. For example, as illustrated in FIG. 4B, the supply pump 118 may be activated to begin a flow 406 of liquid 112 from the holding sump 108 to the testing cavity 111 of the testing sump 110. In an embodiment, the supply pump 118 may be automatically activated when the target level is reached. In an embodiment, the supply pump 118 may be actuated by the controller 136. In an embodiment, the supply pump 118 may be actuated by the monitoring device 202 by a command sent to the controller 136 and/or directly to the supply pump 118. In an embodiment, the supply pump 118 may be actuated manually by a user of the mobile testing system 100.

Optionally, the valve 124 may be actuated to open the test supply line 122. The valve 124 may be actuated by the controller 136. In an embodiment, the valve 124 may be actuated by the monitoring device 202 by a command sent to the controller 136 and/or directly to the valve 124. In an embodiment, the valve 124 may be actuated manually by a user of the mobile testing system 100.

Figure 4C:
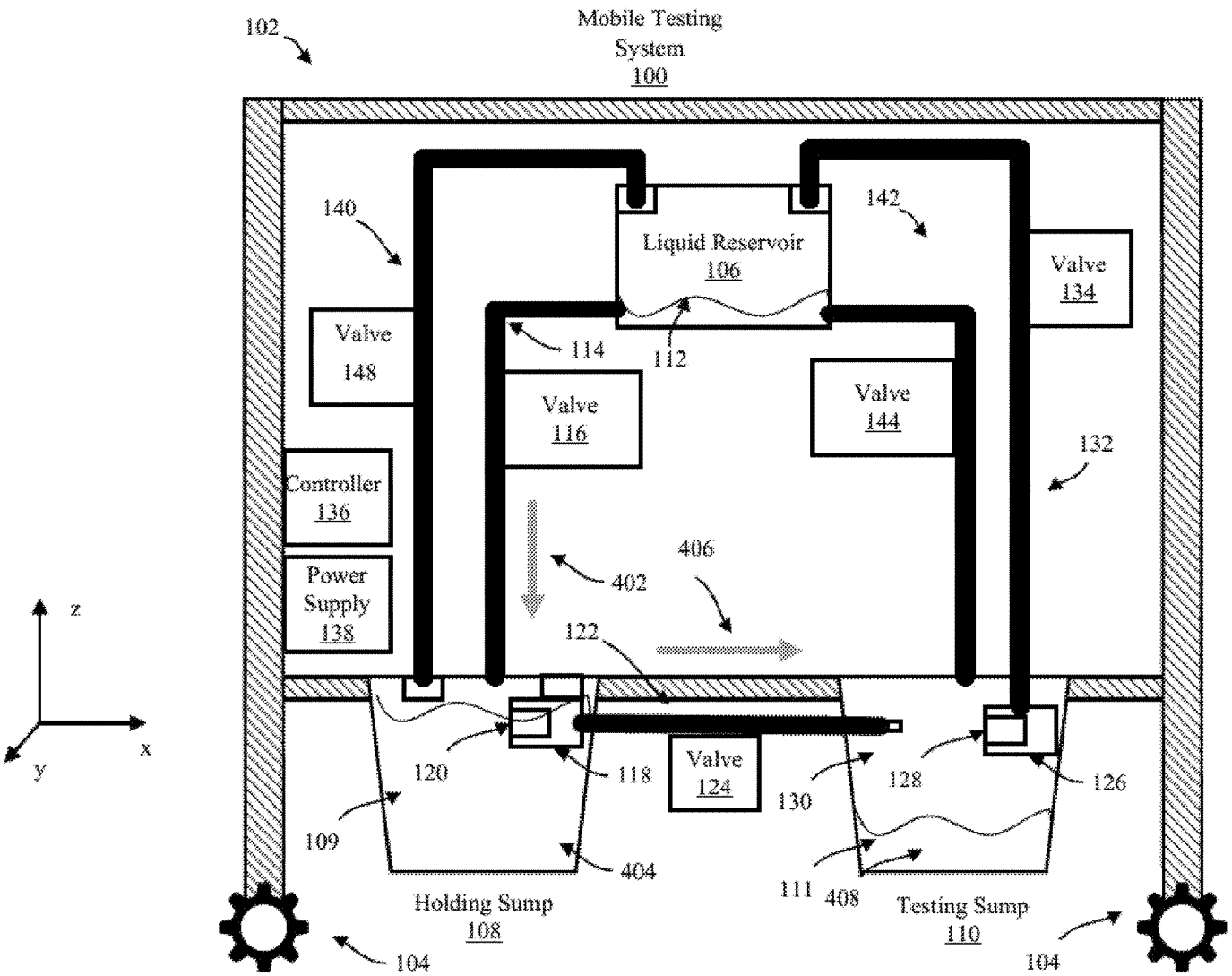
Figure 4D:
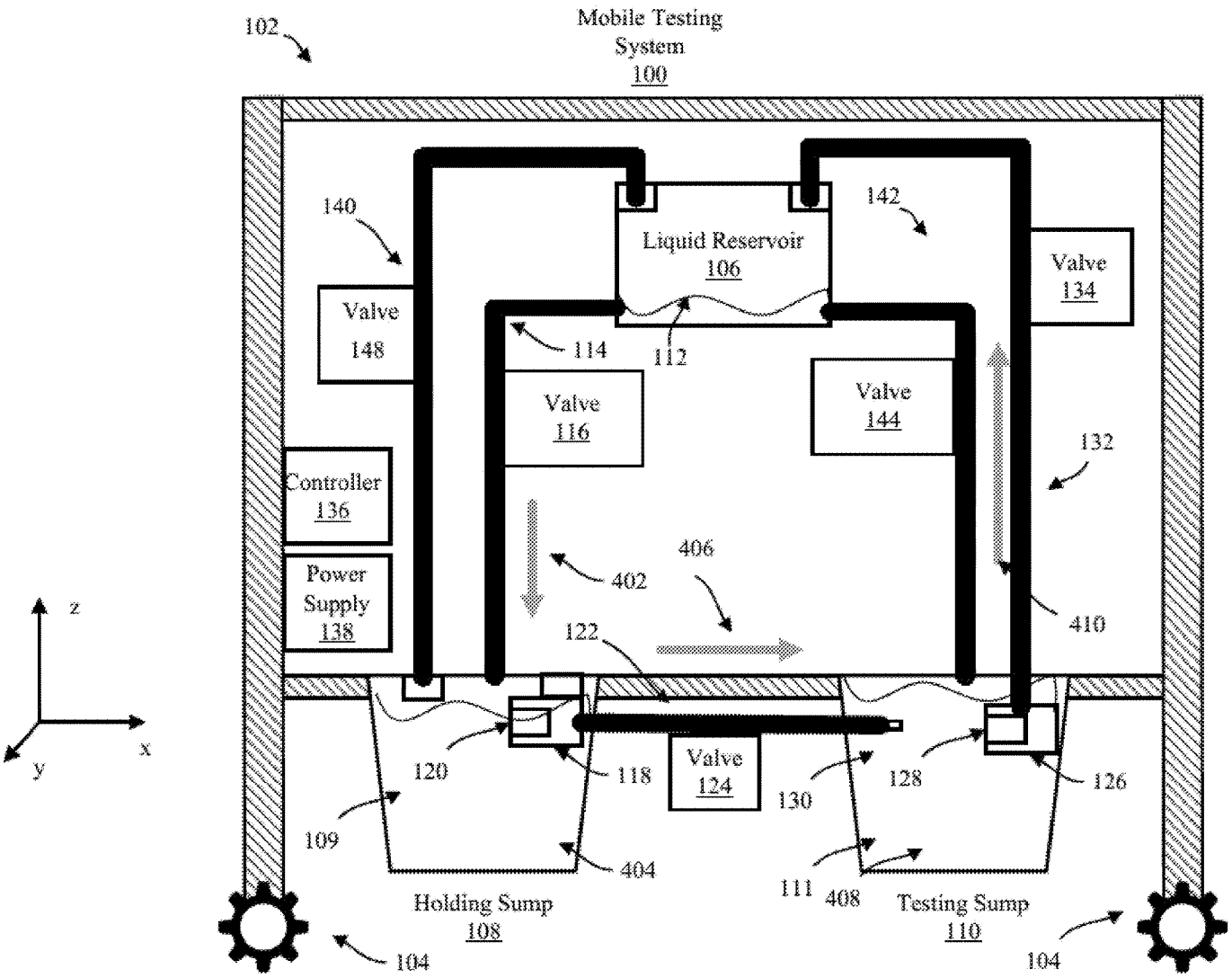
Figure 4E:
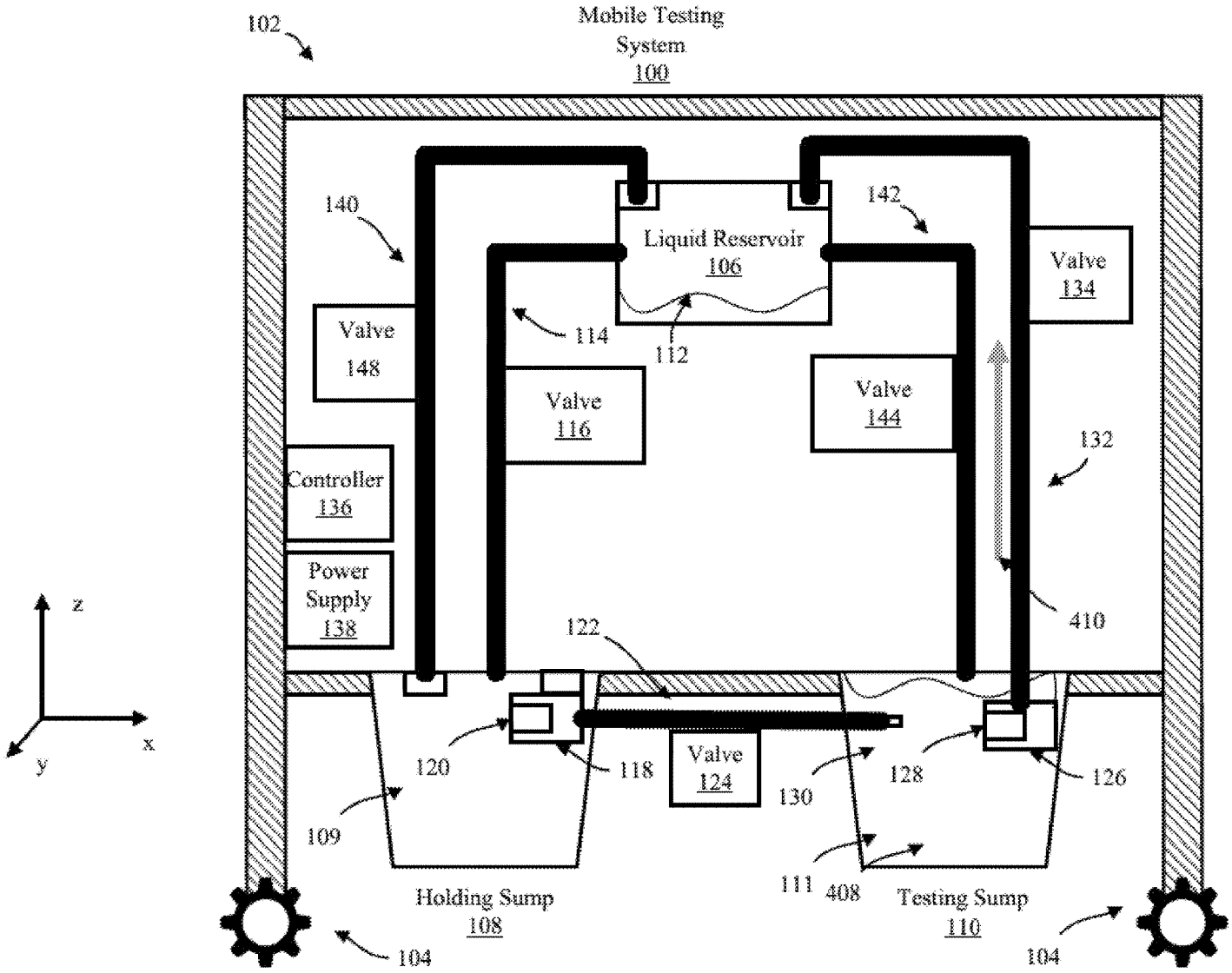

At block 312, the equipment under test in the testing sump may be monitored. For example, as the liquid 112 is supply to the testing cavity 111 of the testing sump 110, the liquid level 408 may rise in the testing cavity 111 over time, as illustrated in FIGS. 4C and 4D. The sensor 128 and the stand-alone sensors 130 may monitor the liquid level 408 in the testing cavity. The sensors 128 and the stand-alone sensors 130 may monitor other testing data such as power usage data, activation time data, operating time data, liquid flow rate data, pressure data, temperate data, error message data, images, video, and the like. The testing data may be transmitted and/or retrieved by the monitoring device 202.

During the test, sensor 128 and the stand-alone sensors 130 may monitor the liquid level 408 in the testing cavity 111 in order to initiate a flow 410 of the liquid 112 through return line 132. This allows to the liquid to be returned to the liquid reservoir 106. For example, as illustrated in FIG. 4D, the sump pump 126 may be activated to begin the flow 410 of liquid 112 from the testing sump 110 in the testing cavity 111 to the liquid reservoir 106. In an embodiment, the sump pump 126 may automatically activated when the target level is reached. In an embodiment, the sump pump 126 may be actuated by the controller 136. In an embodiment, the sump pump 126 may be actuated by the monitoring device 202 by a command sent to the controller 136 and/or directly to the sump pump 126. In an embodiment, the sump pump 126 may be actuated manually by a user of the mobile testing system 100.

Optionally, the valve 134 may be actuated to open the return line 132. The valve 134 may be actuated by the controller 136. In an embodiment, the valve 134 may be actuated by the monitoring device 202 by a command sent to the controller 136 and/or directly to the valve 134. In an embodiment, the valve 134 may be actuated manually by a user of the mobile testing system 100.

At block 314, it may be determined if the test has ended. For example, the test may be ended by a user of the mobile testing system 100 and/or a user of the monitoring device 202. The test may be ended automatically by the mobile testing system 100 and/or a user of the monitoring device 202 due to one or more predetermined conditions such as testing errors, elapsed time period, etc. If the test has not ended, the method 300 may return to block 312 to continue monitoring the equipment under test. If the test has ended, at block 316, the liquid flow may be terminated. For example, the valve 116 may be actuated to stop the flow 402 of the liquid. The supply pump 118 and the sump pump 126 may continue to operate until the liquid is returned to the liquid reservoir.

At 318, data obtained from the equipment under test may be analyzed. For example, the monitoring device 202 may analyze the testing data to determine the operational effectiveness of the water mitigation equipment. For instance, the monitoring device 202 may analyze the test data to determine a response time of the sump pump 126, an accuracy of the sensor 128, an accuracy of the stand-alone sensors 130, errors or faults in the equipment, and the like.

The following considerations also apply to the foregoing discussion. Throughout this specification, plural instances may implement operations or structures described as a single instance. Although individual operations of one or more methods are illustrated and described as separate operations, one or more of the individual operations may be performed concurrently, and nothing requires that the operations be performed in the order illustrated. These and other variations, modifications, additions, and improvements fall within the scope of the subject matter herein.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

In addition, use of "a" or "an" is employed to describe elements and components of the embodiments herein. This is done merely for convenience and to give a general sense of the invention. This description should be read to include one or at least one and the singular also may include the plural unless it is obvious that it is meant otherwise.

Upon reading this disclosure, those of skill in the art will appreciate still additional alternative structural and functional designs for providing feedback to owners of properties, through the principles disclosed herein. Therefore, while particular embodiments and applications have been illustrated and described, it is to be understood that the disclosed embodiments are not limited to the precise construction and components disclosed herein. Various modifications, changes, and variations, which will be apparent to those skilled in the art, may be made in the arrangement, operation and details of the method and apparatus disclosed herein without departing from the spirit and scope defined in the appended claims.

The patent claims at the end of this patent application are not intended to be construed under 35 U.S.C. § 112 (f) unless traditional means-plus-function language is expressly recited, such as "means for" or "step for" language being explicitly recited in the claim(s). The systems and methods described herein are directed to an improvement to computer functionality and improve the functioning of conventional computers.

What is claimed:

1. A device for simulating water intrusion into a structure, the device comprising:

a liquid reservoir comprising a supply cavity configured to hold a volume of a liquid;

a holding sump including a holding cavity;

a first supply line coupled between the liquid reservoir and the holding sump, wherein the first supply line allows the liquid to flow to the holding cavity of the holding sump;

a testing sump including a testing cavity, wherein the testing cavity is configured to receive one or more devices for testing;

a second supply line coupled between the holding sump and the testing sump, wherein the second supply line allows the liquid to flow from the holding cavity of the holding sump to the testing cavity of the testing sump; and a return line coupled between the testing sump and the liquid reservoir, wherein the return line allows the liquid to flow from the testing cavity of the testing sump to the supply cavity of the liquid reservoir.

2. The device of claim 1, further comprising:

a scaffolding configured to support the liquid reservoir, the holding sump, and the testing sump, wherein the scaffolding comprises one or more casters coupled to lower section of the scaffolding.

3. The device of claim 2, further comprising:

a first valve coupled to the first supply line, wherein:

the liquid reservoir is coupled to an upper section of the scaffolding at a higher gravitational potential than the holding sump, and actuation of the first valve causes the liquid to flow from the liquid reservoir to the holding cavity of the holding sump due to gravitational force.

4. The device of claim 1, further comprising:

a supply pump is positioned within the holding cavity of the holding sump and is configured to pump water from the holding cavity of the holding sump to the testing cavity of the testing sump via the second supply line.

5. The device of claim 4, further comprising:

one or more sensors positioned within the holding cavity of the holding sump, wherein the one or more sensors detect a holding level of the liquid in the holding cavity, wherein the supply pump is activated when the holding level of the liquid reaches a holding target level.

6. The device of claim 1, further comprising:

a test pump positioned within testing cavity of the testing sump, wherein the test pump is included in the one or more devices for testing.

7. The device of claim 6, wherein the test pump is configured to pump water from the testing cavity of the testing sump to the liquid reservoir via the return line.

8. The device of claim 6, further comprising:

one or more test sensors positioned within the testing cavity of the testing sump, wherein the one or more test sensors are included in one or more test devices.

9. The device of claim 8, wherein the one or more test sensors detect a test level of the liquid in the testing cavity of the testing sump, wherein a supply pump is activated when a holding level of the liquid in the holding cavity reaches a holding target level.

10. The device of claim 1, further comprising:

a controller is configured to initiate a flow of the liquid.

11. A system for simulating a structure and testing water mitigation equipment, the system comprising:

a liquid reservoir comprising a supply cavity configured to hold a volume of a liquid;

a holding sump including a holding cavity;

a first supply line coupled between the liquid reservoir and the holding sump, wherein the first supply line allows the liquid to flow to the holding cavity of the holding sump;

a testing sump including a testing cavity, wherein the testing cavity is configured to receive one or more devices for testing;

a second supply line coupled between the holding sump and the testing sump, wherein the second supply line allows the liquid to flow from the holding cavity of the holding sump to the testing cavity of the testing sump;

a return line coupled between the testing sump and the liquid reservoir, wherein the return line allows the liquid to flow from the testing cavity of the testing sump to the supply cavity of the liquid reservoir; and a monitoring device configured to communicate with the one or more devices and to collect testing data representing an operation of the one or more devices.

12. The system of claim 11, further comprising:

a scaffolding configured to support the liquid reservoir, the holding sump, and the testing sump, wherein the scaffolding comprises one or more casters coupled to lower section of the scaffolding.

13. The system of claim 11, wherein the one or more devices comprise a sump pump and a sensor.

14. The system of claim 11, wherein the monitoring device communicates with the one or more devices via one or more networks.

15. The system of claim 11, wherein the monitoring device analyzes the testing data using one or more machine learning algorithms.

16. A method for testing water mitigation equipment, the method comprising:

initiating a flow of a liquid from a holding sump into a testing sump, wherein the testing sump includes a testing cavity and one or more devices for testing positioned within the testing cavity, wherein the holding sump is coupled to a liquid reservoir, and wherein the testing sump is coupled to the liquid reservoir by a return line to allow the liquid to flow from the testing cavity to a supply cavity of the liquid reservoir;

receiving, at one or more processors, test data from the one or more devices;

determining, by the one or more processors, that the one or more devices pass or fail water mitigation based at least partially on the test data; and outputting, by the one or more processors, a pass or fail result for the one or more devices.

17. The method of claim 16, wherein initiating the flow of the liquid from the holding sump into the testing sump comprises:

actuating a valve that causes the liquid to flow from the liquid reservoir to a holding cavity of the holding sump due to gravitational force; and activating a pump that causes the liquid to flow from the holding cavity of the holding sump to the testing cavity of the testing sump.

18. The method of claim 16, wherein determining that the one or more devices pass or fail water mitigation comprises:

determining, by the one or more processors, an operational performance of the one or more devices in removing water from the testing cavity of the testing sump.

19. The method of claim 16, wherein determining that the one or more devices pass or fail water mitigation comprises:

determining, by the one or more processors, an operational performance of the one or more devices in detecting a level of the liquid within the testing cavity of the testing sump.

20. The method of claim 16, wherein determining that the one or more devices pass or fail water mitigation comprises:

analyzing, by the one or more processors, the test data using one or more machine learning algorithms.

* * * * *